United States Patent [19]

Welch

[11] Patent Number: 5,059,937

[45] Date of Patent: Oct. 22, 1991

[54] SWITCH ASSEMBLY

[75] Inventor: Richard E. Welch, Lexington, Ohio

[73] Assignee: Therm-O-Disc, Incorporated, Mansfield, Ohio

[21] Appl. No.: 602,462

[22] Filed: Oct. 23, 1990

[51] Int. Cl.[5] ..... H01H 37/04; H01H 37/52

[52] U.S. Cl. ..... 337/380; 200/305; 337/354; 337/365

[58] Field of Search ..... 337/380, 354, 365, 381, 337/112, 113; 200/305; 403/383

[56] References Cited

U.S. PATENT DOCUMENTS

| | | | |
|---|---|---|---|
| 2,346,162 | 4/1944 | Hanopol | 174/151 |
| 2,450,423 | 10/1948 | Fraser et al. | 174/52.3 |
| 3,173,122 | 3/1965 | Murry | 338/332 |
| 3,259,721 | 7/1966 | Morris | 337/354 |
| 3,355,563 | 11/1967 | Ruckriegel | 337/354 |
| 4,059,817 | 11/1977 | Hollweck et al. | 337/365 |

*Primary Examiner*—Harold Broome

*Attorney, Agent, or Firm*—Jones, Day, Reavis & Pogue

[57] ABSTRACT

A thermostatic switch having a switch case and disc cup cooperatively shaped for assembly in selective aligned relationship against relative rotation.

11 Claims, 4 Drawing Sheets

SWITCH ASSEMBLY

BACKGROUND OF THE INVENTION

This application relates to the art of switches and, more particularly, to arrangements for securing switch housing parts together. The invention is particularly applicable for use in thermostatic switches and will be described with specific references thereto. However, it will be appreciated that the invention has broader aspects, and can be used in other types of switch assemblies.

A well-known type of thermostatic switch assembly includes a cylindrical switch case attached to a cylindrical metal disc cup. The switch case and disc cup are secured together by roll crimping an end portion of the cup peripheral wall over a circular flange on the switch case. The switch case and disc cup tend to rotate relative to one another during the roll crimping operating, and this can disrupt a desired angular orientation between the two parts. After roll crimping, it may be necessary to forcibly rotate the two parts relative to one another for placing same back in a desired angular orientation. In addition to being time consuming and difficult, forced relative rotation between the parts subsequent to roll crimping loosens the joint between the two parts.

It would be desirable to have a simple way of locating a switch case and disc cup in a desired angular orientation during assembly, and for automatically holding same in such orientation during roll crimping.

SUMMARY OF THE INVENTION

A thermostatic switch assembly of the type described has a switch case and disc cup with cooperative non-circular peripheral shapes. The special cooperative shape of the parts allows quick assembly of same in a desirable angular orientation, and prevents relative rotation between the two during a roll crimping operation. In a preferred arrangement, the cooperative non-circular shapes on the switch case and disc cup are polygonal. Most preferably, the shapes are equilateral polygons having at least eight sides.

The switch case has an open end and an outer cylindrical surface. A flange of polygonal peripheral shape extends outwardly from the cylindrical outer surface of the switch case adjacent its open end. A circumferential recess in the open end of the switch case receives a bumper guide disc.

The metal disc cup has an open end for closely receiving the switch case polygonal flange with an interference fit. The disc cup has a depth, and the polygonal portion of the cup peripheral wall extends over a depth less than the disc cup depth. The depth of the polygonal portion of the disc cup peripheral wall is also substantially greater than the thickness of the flange on the switch case. This allows the terminal end portion of the polygonal wall portion of the disc cup to be roll crimped over the switch case flange.

The polygonal portion of the disc cup peripheral wall meets a cylindrical portion of the cup wall at a peripheral intersection. A plurality of circumferentially-spaced shoulders are provided around the peripheral intersection for abutment by the open end of the switch case.

Orientable features on the switch case and disc cup can be aligned during assembly of the switch case and disc cup by using the cooperative polygonal shapes to position the parts. The desired alignment achieved during initial assembly is held during roll crimping because the polygonal shape provides abutment surfaces that prevent relative rotation between the switch case and disc cup.

It is a principal object of the present invention to provide an improved arrangement for attaching a thermostat disc cup to a switch case.

It is another object of the invention to provide a switch case and disc cup with cooperative shapes for preventing relative rotation between same.

It is a further object of the invention to provide an improved disc cup for use with thermostat switch cases.

It is also an object of the invention to provide an arrangement for assembling a switch case and disc cup in aligned relationship against relative rotation.

DESCRIPTION OF A PREFERRED EMBODIMENT

Figure 1:
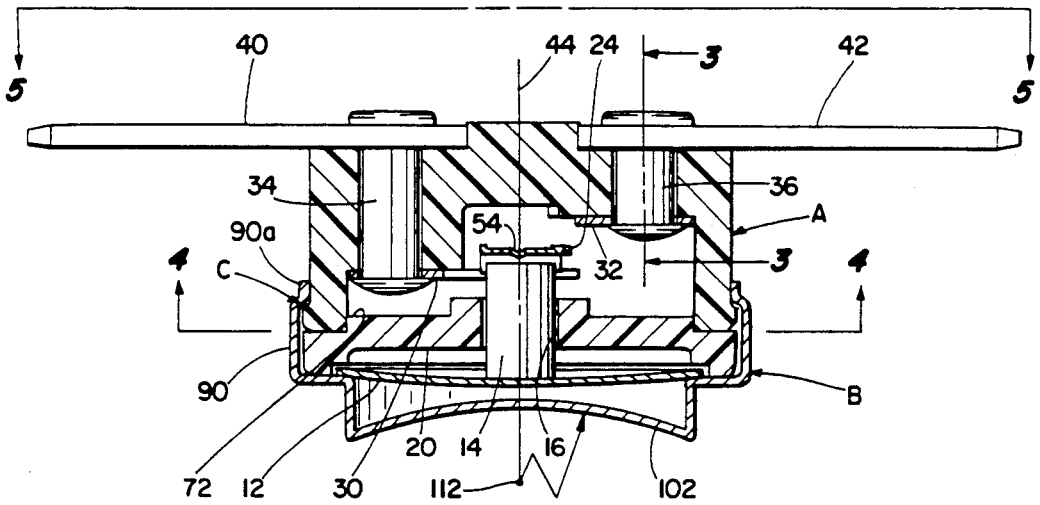
FIG. 1 is a cross-sectional elevational view of a thermostatic switch assembly having the improvements of the present application incorporated therein.
Figure 2:
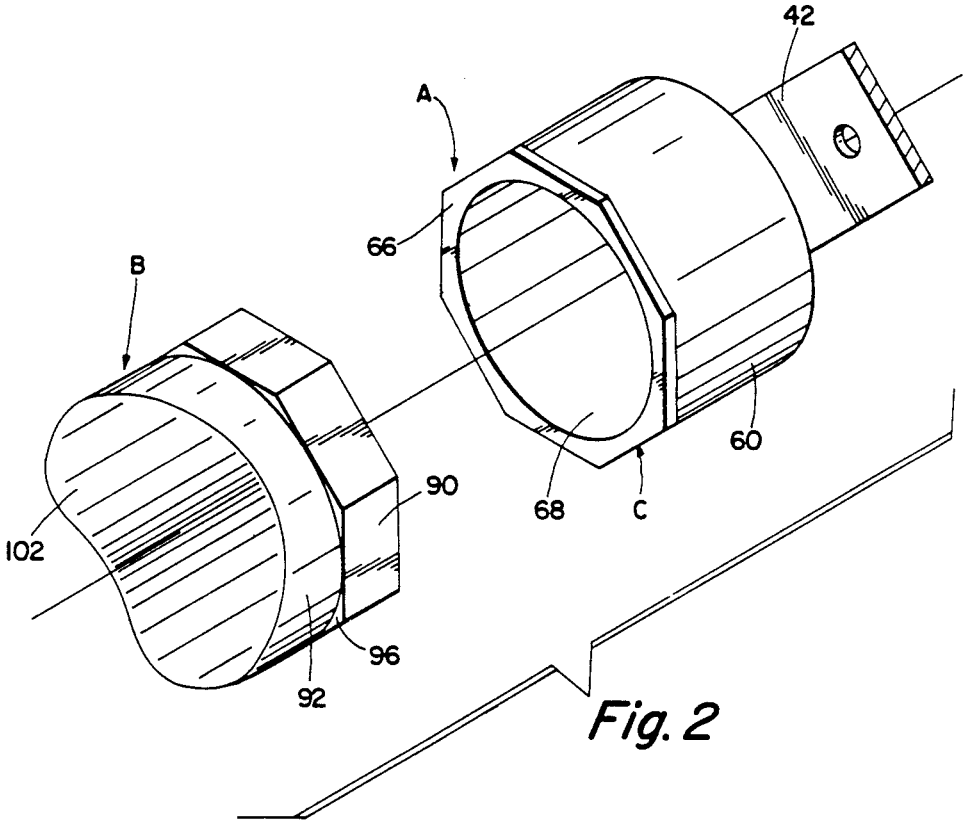
FIG. 2 is an exploded perspective illustration of a switch case and disc cup constructed in accordance with the present application.

Referring now to the drawing, wherein the showings are for purposes of illustrating a preferred embodiment of the invention only and not for purposes of limiting same, FIG. 1 shows a thermostatic switch assembly including a switch case A and a metal disc cup B.

A curved bi-metal disc 12 positioned within cup B cooperates with a reciprocating cylindrical bumper 14 guided through a central hole 16 in a bumper guide disc 20. When bi-metal disc 12 reaches a certain temperature, it snaps to a reversed curvature from that shown for moving bumper 14 upwardly to raise movable switch arm 24 and separating a pair of contacts.

Fixed and movable contact plates 30, 32 are secured within a cavity in switch case A by rivets 34, 36. Terminals 40, 42 are secured to the outer bottom surface of switch case A by rivets 34, 36. In the arrangement shown, terminals 40, 42 extend along a common axis perpendicular to the longitudinal axis 44 of the thermostatic switch assembly that passes through the centers of switch case A and disc cup B.

Figure 3:
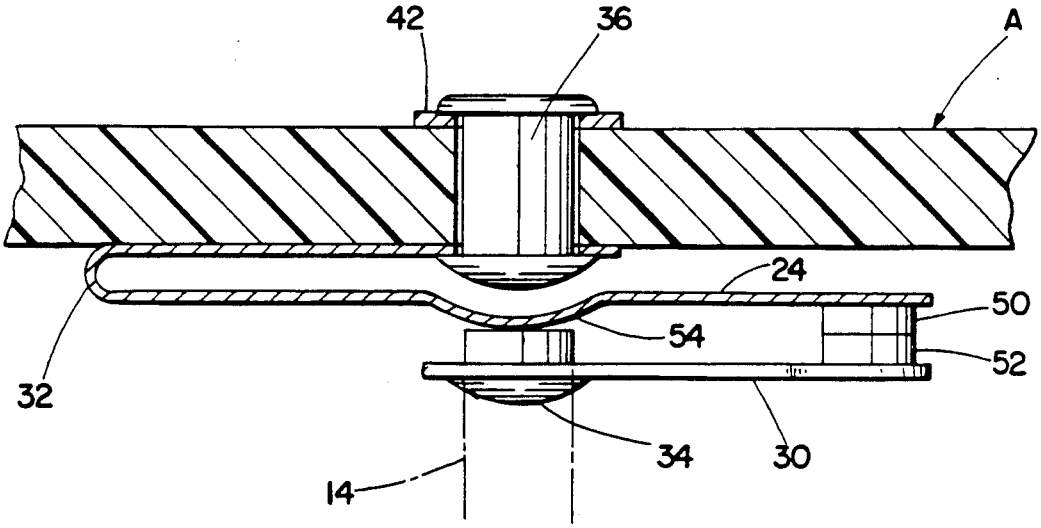
FIG. 3 is a partial cross-sectional elevational view taken generally on line 3—3 of FIG. 1, and with portions omitted for clarity of illustration.
Figure 4:
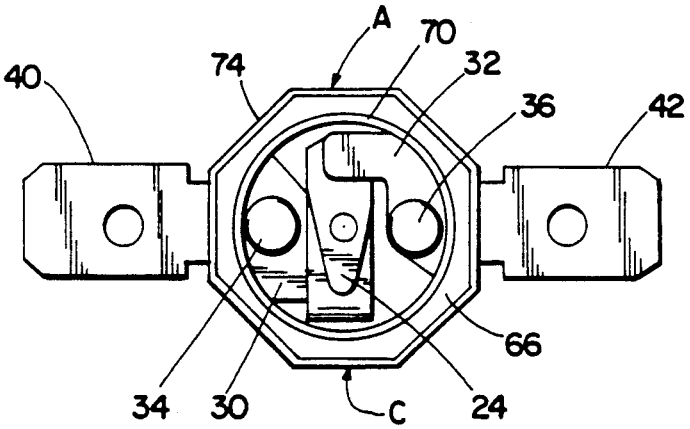
FIG. 4 is a bottom plan view looking into the open end of a switch case as indicated on line 4—4 of FIG. 1.
Figure 5:
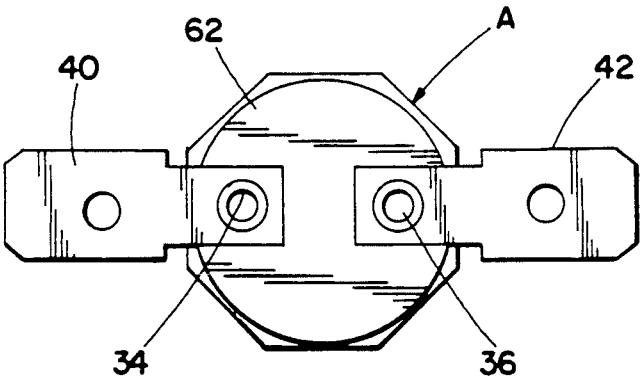
FIG. 5 is a top plan view taken generally on line 5—5 of FIG. 1.

As shown in FIG. 3, movable terminal plate 32 has an integral reversely curved portion that forms movable arm 24 which carries movable contact 50 cooperating with fixed contact 52 on fixed contact plate 30. A dimple 54 in movable arm 24 is engageable by bumper 14 of FIG. 1. Contacts 50, 52 are normally closed as shown in FIG. 3 due to bending stress in movable arm 24. The contacts are separated by upward movement of bumper 14. When the bi-metal disc cools, it again snaps back to the position shown in FIG. 1 and allows the contacts to close.

Figure 6:
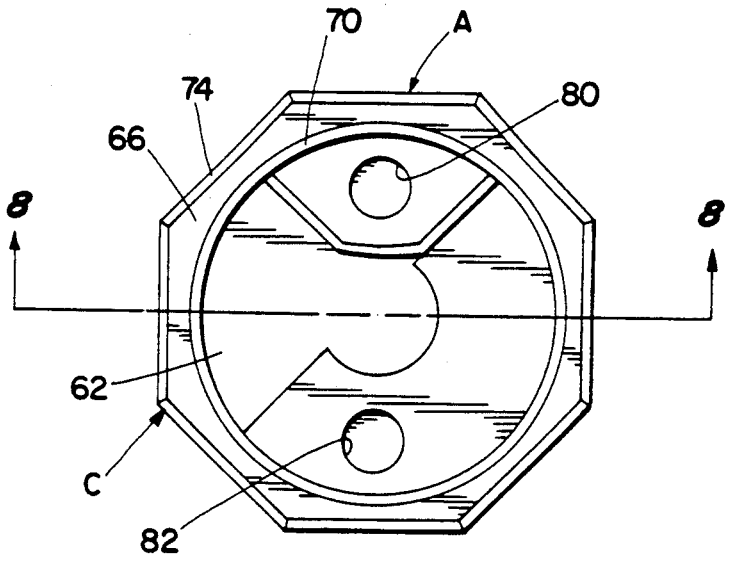
FIG. 6 is a bottom plan view showing the open end of a switch case.
Figure 7:
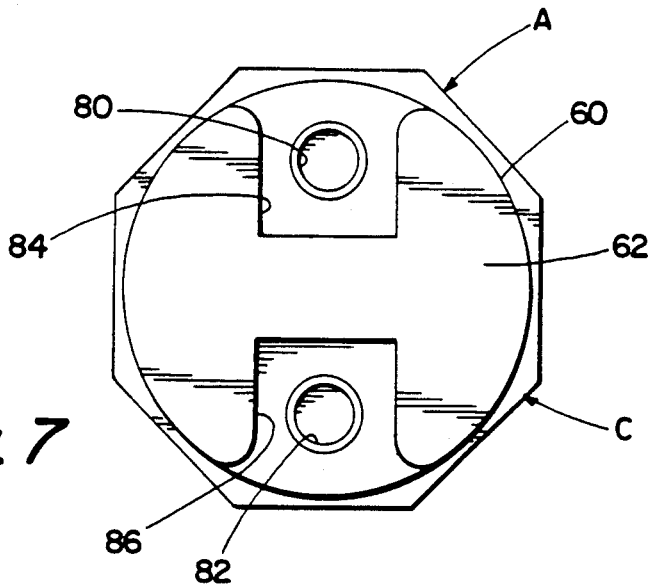
FIG. 7 is a top plan view showing the top of a switch case.
Figure 8:
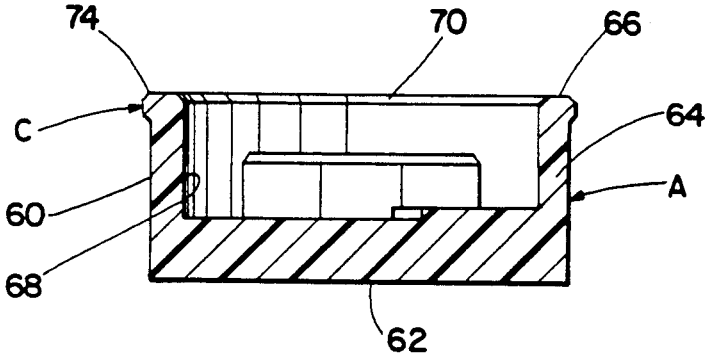
FIG. 8 is a cross-sectional elevational view taken generally on line 8—8 of FIG. 6.
Figure 9:
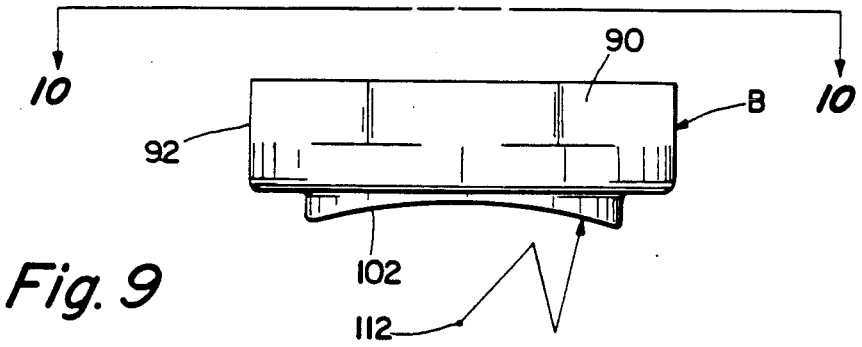
FIG. 9 is a side elevational view of a metal disc cup constructed in accordance with the present application.

FIGS. 6–8 show switch case A as being generally cylindrical and having an outer cylindrical surface 60. Switch case A has a substantially closed bottom wall 62 and a cylindrical peripheral wall 64 extending therefrom. Peripheral wall 64 terminates at a circular flat terminal end 66 surrounding an open end of switch case A that provides access to a switch case cavity in which the switch is mounted.

Peripheral wall 64 of switch case A has an inner cylindrical surface 68, and a circumferential recess 70 is provided between inner surface 68 and terminal end 66 for receiving a circular rear projection 72 on bumper guide disc 20 of FIG. 1. The circular outer periphery of bumper guide disc 20 has substantially the same diameter as the outer edge of flat terminal end 66 on switch case wall 64.

A thin circumferential flange C extends outwardly from switch case peripheral wall 64 adjacent terminal end 66 thereof. A circumferential chamfer 74 extends between terminal end 66 and flange C to facilitate insertion of flange C within a disc cup.

In the preferred arrangement shown, flange C has an equilateral octagonal peripheral shape. It will be recognized that other non-circular or polygonal shapes can also be provided, and that a polygonal shape does not necessarily have to be equilateral. In the preferred arrangement, the polygonal shape has at least eight sides. This facilitates forming the polygonal end portion and roll crimping same over the switch case flange.

As shown in FIGS. 6 and 7, switch case A has rivet receiving holes 80, 82 therethrough. Terminal receiving recesses 84, 86 in the outer back surface of switch case bottom wall 62 receive end portions of terminals 40, 42 for preventing rotation of same around the rivets.

Disc cup B has a peripheral wall portion that includes a terminal wall portion 90 that is dimensioned and shaped for closely receiving flange C on switch case A. In the arrangement shown, terminal wall portion 90 is of equilateral octagonal peripheral shape. However, it will be recognized that other non-circular shapes can also be provided. The desired arrangement is one where the switch case and disc cup are cooperatively shaped to allow alignment of same in a desired orientation during assembly, and to prevent relative rotation once assembly is achieved.

Polygonal terminal wall portion 90 meets a cylindrical wall portion 92 at a peripheral intersection 94 having a plurality of shoulders 96 equidistantly-spaced circumferentially therearound. Shoulders 96 face toward the open end of disc cup B and define shoulder means for abutment by corner portions of switch case flange C. This limits the insertion of switch case A into disc cup B.

Flange C on switch case A has a certain thickness measured longitudinally of the switch case and disc cup B has a predetermined depth. The depth of polygonal wall portion 90 is less than the total depth of the disc cup, but substantially greater than the thickness of flange C. Therefore, when the switch case is received in the disc cup, as shown in FIG. 1, the terminal end portion of the peripheral wall on disc cup A can be roll formed inwardly over flange C as shown at **90*a*** for locking the switch case and disc cup together. The polygonal shapes on the switch case and disc cup provide abutment surfaces engaging one another to prevent relative rotation between the switch case and disc cup.

Figure 10:
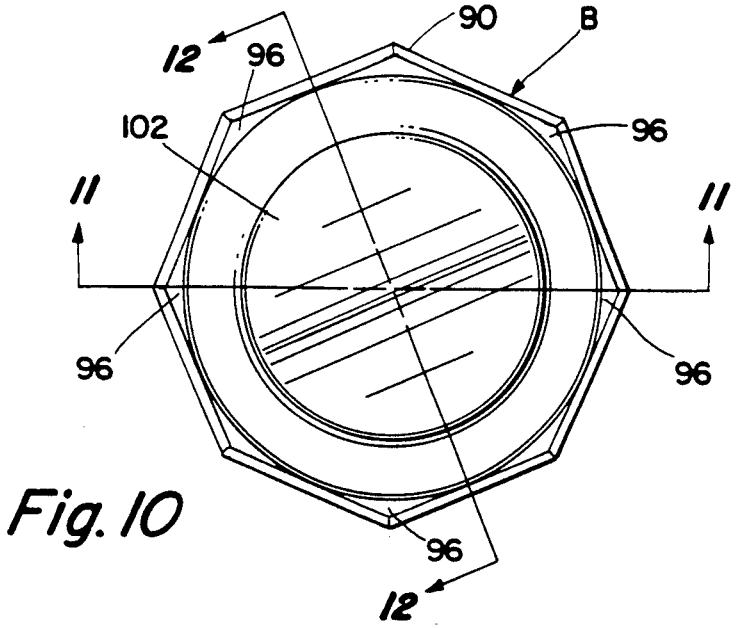
FIG. 10 is a top plan view taken generally on line 10—10 of FIG. 9.
Figure 11:
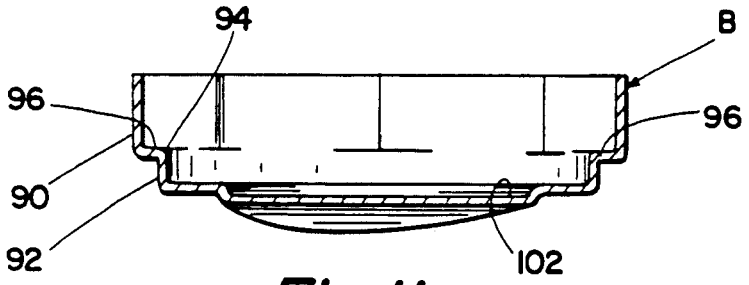
FIG. 11 is a cross-sectional elevational view taken generally on line 11—11 of FIG. 10.
Figure 12:
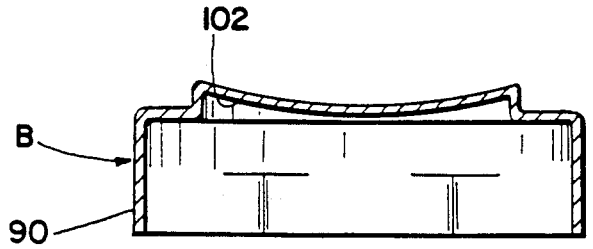
FIG. 12 is a cross-sectional elevational view taken generally on line 12—12 of FIG. 10.

In many instances, the switch case and disc cup have orientable features that are preferably in a desired orientation when the disc cup is assembled to the switch case. FIGS. 10–12 show a bottom depression 102 in disc cup B. In the arrangement shown, depression 102 is curved to extend back toward the open end of disc cup B so it lies on the surface of a cylinder. For example, FIG. 1 shows the curved surface of disc cup depression 102 as being curved to lie on the surface of a cylinder having a central axis 112 extending perpendicular to and intersecting switch case longitudinal axis 44, and also extending perpendicular to the common longitudinal axis of terminals 40, 42. In the arrangement shown, axis 112 also bisects a pair of opposite flat walls on the polygonal wall portion 90 of disc cup B. Thus, disc cup B can be assembled to switch case A with axis 112 extending substantially perpendicular to the common axis of terminals 40, 42.

Obviously, the cooperative octagonal shape of the switch case and disc cup would also allow assembly with axis 112 extending parallel, perpendicular or at 45° to the common longitudinal axis of terminals 40, 42. Other reference points can also be used if so desired for desirably orienting the disc cup when it is positioned over the flange on the switch case. For example, rivets 34, 36 provide a reference point or axis.

With the arrangement shown and described, the cylindrical curved surface on the depression 102 of disc cup B can be placed against the outer surface of a cylindrical roller while terminals 40, 42 are in a desirable and necessary orientation for connection to a circuit. Obviously, other parts may also be attached to disc cup B such as a mounting bracket, that requires special orientation relative to terminals or another reference feature on switch case A in order to properly fit within an environment where the thermostatic switch assembly will be used.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

I claim:

1. In a thermostatic switch assembly including a switch case and a disc cup, said switch case including a peripheral wall having an outer surface and an open end, a flange extending radially outwardly from said outer surface of said peripheral wall adjacent said open end thereof, said disc cup having an open end portion closely receiving said flange, said flange and said open end portion of said disc cup having non-circular cooperative peripheral shapes with cooperative abutment surfaces for preventing relative rotation between said switch case and said disc cup, said flange having an outer flange terminal end facing toward said disc cup and having a predetermined flange thickness, said open end portion of said disc cup in which said flange is closely received having a depth greater than said flange thickness and said open end portion of said disc cup having a terminal end portion rolled over on the opposite site of said flange from said flange terminal end.

2. The assembly of claim 1 wherein said flange and said open end portion of said disc cup have polygonal peripheral shapes.

3. The assembly of claim 2 wherein said polygonal peripheral shapes are equilateral.

4. The assembly of claim 2 wherein said open end portion of said disc cup of polygonal peripheral shape extends over only a portion of the total depth of said disc cup and the remaining depth of said disc cup has a circular peripheral shape, said polygonal and circular peripheral shapes intersecting at a peripheral intersection, said polygonal peripheral shape of said disc cup including a plurality of straight sides extending substantially tangent to said circular peripheral shape at said peripheral intersection, and a plurality of circumferentially-spaced shoulders extending radially outwardly of said peripheral intersection between adjacent tangent points of said straight sides with said circular peripheral shape.

5. A switch case comprising a generally cup-shaped body of electrical insulating material, said body including a peripheral wall having a substantially cylindrical outer surface and an open end, a flange extending radially outwardly from said outer surface of said peripheral wall adjacent said open end thereof, said flange having a polygonal peripheral shape.

6. The switch case of claim 5 wherein said polygonal flange is equilateral.

7. The switch case of claim 6 wherein said equilateral polygonal flange has at least eight sides.

8. The switch case of claim 5 wherein said case has a cylindrical inner surface and said open end includes a terminal end, and a circumferential recess between said inner surface and said terminal end.

9. A disc cup for a thermostat, said cup having a peripheral wall, an open end and a depth, said peripheral wall adjacent said open end having a polygonal peripheral portion extending over a portion of said depth, said peripheral wall having a circular peripheral shape over the remainder of said depth beyond said polygonal peripheral portion, said polygonal peripheral portion intersecting said circular peripheral shape at a peripheral intersection that includes shoulder means extending generally radially outwardly from said peripheral intersection and facing outwardly toward said open end for engagement by a switch case, said polygonal peripheral portion including a plurality of straight sides extending substantially tangent to said circular peripheral shape at said peripheral intersection, and said shoulder means comprising a plurality of shoulders circumferentially-spaced around said intersection between adjacent tangent points of said straight sides with said circular peripheral shape.

10. The cup of claim 9 wherein said polygonal peripheral portion has an equilateral polygonal shape.

11. The cup of claim 10 wherein said equilateral polygonal shape has at least eight sides.

* * * * *